United States Patent [19]

Nakamura et al.

[11] 4,236,710

[45] Dec. 2, 1980

[54] SHEET SUPPLYING APPARATUS

[75] Inventors: Takeshi Nakamura; Hiroshi Kushima, both of Minami-ashigara, all of Japan

[73] Assignee: Fuji Photo Film Co., Ltd., Minami-ashigara, Japan

[21] Appl. No.: 907,224

[22] Filed: May 18, 1978

[30] Foreign Application Priority Data

May 24, 1977 [JP] Japan ..... 52-60148

[51] Int. Cl.[3] ..... B65H 3/03; B65H 7/16

[52] U.S. Cl. ..... 271/108; 198/689; 271/107; 271/260

[58] Field of Search ..... 271/108, 96, 107, 105, 271/104, 103, 91, 90, 260, 261; 294/64 R; 414/121; 198/689

[56] References Cited

U.S. PATENT DOCUMENTS

| | | | |
|---|---|---|---|
| 3,617,048 | 11/1971 | Albert | 271/108 |
| 3,754,751 | 8/1973 | Capetti et al. | 271/108 X |

*Primary Examiner*—Bruce H. Stoner, Jr.
*Attorney, Agent, or Firm*—Sughrue, Rothwell, Mion, Zinn and Macpeak

[57] ABSTRACT

A sheet supplying apparatus, in which photographic sheets of various sizes are lifted by a plurality of suction disks, includes edge detectors for detecting the edges of the topmost sheet and disabling any suction disc not completely located on that sheet.

4 Claims, 6 Drawing Figures

SHEET SUPPLYING APPARATUS

BACKGROUND OF THE INVENTION

This invention relates to sheet supplying apparatuses, and more particularly to a sheet supplying apparatus in which sheets different in size stacked in a single container are taken out one after another by a suction device.

In subjecting X-ray photographic sheet films (hereinafter referred to merely as "films" when applicable) to photographical treatment, X-ray films different in size according to the photographed parts or sections are stored in the same container, and these films are taken out of the container in the order of photographing to thereby be supplied to a photographical treatment device such as a developer.

A conventional apparatus for supplying sheets different in size one after another such as that in the above-described film supplying system is as shown in FIG. 1. In this conventional apparatus, a plurality of suction disks 1 are fixedly arranged using the length, in the lateral direction, of the smallest of the sheets 2 as a reference, and the sheets are taken out by grabbing predetermined portions thereof, which are common for all of the sheets regardless of size, with the suction disks 1.

However, the conventional sheet supplying apparatus thus constructed is disadvantageous in the following respects. First, with the conventional sheet supplying apparatus, the relative grabbing position of the suction disks 1 is varied whenever the sheet size is changed; in other words, the grabbing positions on a large size sheet are relatively closer to its one edge than on a small size sheet. Accordingly, sometimes the large size sheet 2 may not be adequately retained by the suction disks 1 because of the weight of the sheet 2 and the negative pressure caused by the large surface area. Futhermore, even if it is retained by the suction disks, its one end portion will be free and therefore, it may be folded when taken out. Thus, it is difficult to supply the sheets 2 one by one. This difficulty becomes more significant as the difference in width between the sheets 2 is increased. Accordingly, in the case of using the conventional apparatus, the variations in sheet size are limited, and it is essential that both opposite edges of sheets 2 in the stack are correctly aligned. Thus, the conventional sheet supplying apparatus is greatly limited in its practical uses.

Accordingly, an object of the invention is to eliminate all the above-described difficulties accompanying a conventional sheet supplying apparatus. More specifically, an object of the invention is to provide a sheet supplying apparatus which can positively supply sheets different in size one after another without damage to the sheets.

The foregoing object of the invention can be achieved by the provision of a sheet supplying apparatus comprising suction disks for grabbing and retaining each sheet, a pressure reducing source for applying a suction pressure to the suction disks, a driving means for driving the suction disks, to thereby grab and take out sheets different in size one after another, in which apparatus, according to the present invention, a plurality of suction disks for grabbing and retaining a sheet are juxtaposed in a lateral direction of the sheets, and a sheet edge detector for detecting an edge of a sheet to be taken out is provided for each of the suction disks, in such a manner that when the sheet edge detector detects the edge of the sheet, the pressure in the corresponding suction disk is reduced.

DETAILED DESCRIPTION OF THE PREFERRED EMBODIMENT

Figure 1:
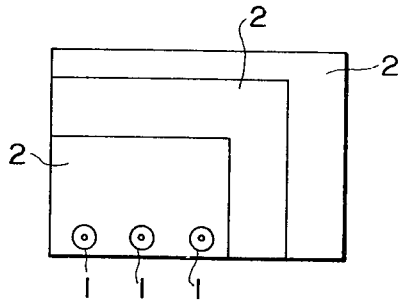
FIG. 1 PRIOR ART
FIG. 1 is an explanatory diagram for a description of a conventional sheet supplying apparatus.
Figure 2:
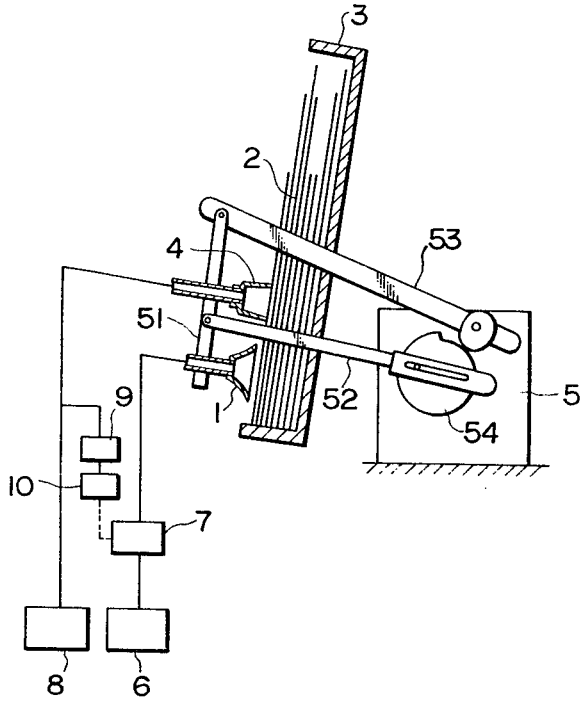
FIG. 2 is a sectional side elevation showing one example of a sheet supplying apparatus according to the invention.
Figure 3:
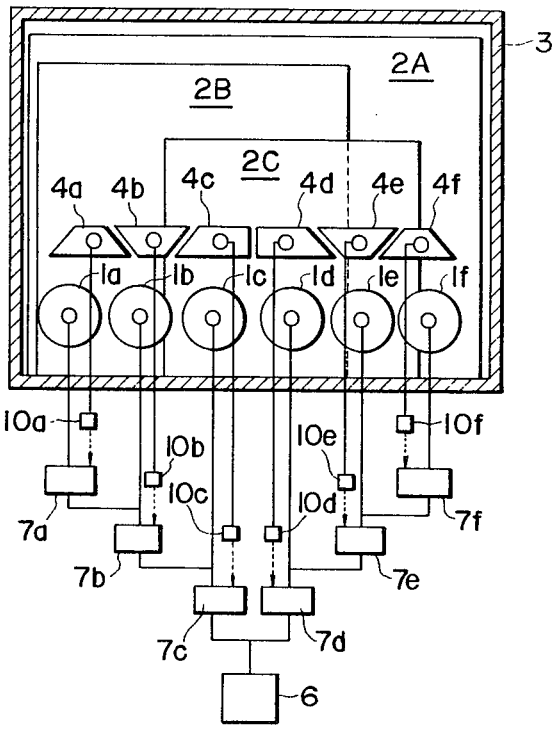
FIG. 3 is a front view of the apparatus shown in FIG. 2.

FIG. 2 is a sectional side view showing one example of a sheet supplying apparatus according to the present invention. FIG. 3 is a front view showing the sheet supplying apparatus of FIG. 2. Both of FIGS. 2 and 3 are schematic diagrams for a description of the technical concept of the invention.

Referring to FIG. 2, reference numeral 1 designates a suction disk; 2 designates sheets to be taken out; 3 a sheet container storing the sheets 2; 4 a detecting means for detecting the lateral ends of each sheet 2; 5 a driving device for driving the suction disk 1 and the detecting means 4; 6 a pressure reducing source coupled to the suction disk 1; 7 a solenoid valve provided between the pressure reducing source 6 and the suction disk 1; 8 a pressure reducing source coupled to the detecting means 4; 9 a hollow elastic member having one end connected to the pressure reducing source 8 and the other end sealed, the hollow elastic member being capable of expanding and contracting; and 10 a limit switch adapted to produce a signal in association with the hollow elastic member 9, the signal being applied to the solenoid valve 7.

The suction disk 1 is a well known one which is made of, for instance, "Neoprene rubber". A plurality of suction disks (which will be designated by 1*a*, 1*b*, . . . If for convenience in this description) are arranged in the lateral direction of the container 3 at equal intervals as shown in FIG. 3.

The sheets 2 are stored in the container 3 which is held substantially vertically. In stacking the sheets 2 in the container 3 it is unnecessary to collect the sheets separately according to their sizes in advance, or to align their lateral ends correctly, and they may be stacked disorderly. (For convenience in this description, the sheets are classified into three groups: sheets of large size 2A, sheets of middle size 2B, and sheets of small size 2C.) The driving device 5 comprises operating rods 52 and 53 which operate to vertically and horizontally reciprocate an arm 51 having the suction disk 1 and the detecting means 4, and also comprises a driving source 54, so that the suction disk 1 grabs and retains the sheet 2 to thereby take it out of the container 3. The driving device 5 is such a one as disclosed by Japanese Utility Model Application Laid Open No. 20670/1977.

The detecting means 4 is made of an elastic material similar to the suction disk 1. The lip of the detecting means 4 is thicker than that of the suction disk 1. The detecting disk is trapezoidal as shown in FIG. 3, and is a kind of suction means. A plurality of such detecting means 4 are arranged side by side in correspondence to the suction disks 1 in such a manner that the oblique lines thereof overlap along the lateral direction of the container 3. (For convenience in description, these detecting means will be designated by 4*a*, 4*b*, . . . 4*f*.) The detecting means serves to suck and retain the sheet 2 similar to the suction disk 1, but it does not serve to take the sheet out of the container. That is, the function of the detecting means is to detect the positions of the lateral ends of a sheet 2 to be taken out, to thereby determine whether or not suction pressure should be applied to the suction disks corresponding to each detecting means. (This detection principle will be described with reference to FIG. 4.)

The solenoid valve 7 is operated by a signal transmitted by the limit switch 10. The first end of each solenoid valve 7*a*, 7*b*, . . . 7*f* is connected to a suction disk 1*a*, 1*b*, . . . 1*f*, respectively, but the second end thereof is not directly connected to the pressure reducing source 6; rather they are connected in such a manner that, as shown in FIG. 3, the second end of the solenoid valve 7*a* is connected to the solenoid valve 7*b*, the second end of the solenoid valve 7*b* is connected to the solenoid valve 7*c*, the second end of the solenoid valve 7*f* is connected to the solenoid valve 7*e*, the second end of the solenoid valve 7*e* is connected to the solenoid valve 7*d*, and the second ends of the solenoid valves 7*c* and 7*d* are connected to the pressure reducing source 6. Thus, the solenoid valves 7*a* through 7*f* are symmetrically arranged to form two systems.

The sheet supplying apparatus thus constructed operates to detect a sheet 2 to be taken out by means of the detecting means 4, and to reduce the pressures in the suction disks 2 not required for taking out the sheet.

The operation of the sheet supplying apparatus in combination with the principle of detecting the sheet 2 by means of the detecting means 4 will now be described.

Figure 4:
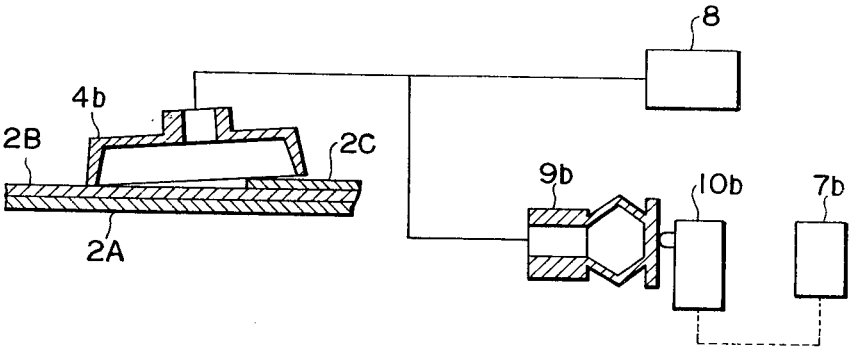
FIG. 4 is an explanatory diagram for a description of a sheet edge detecting principle.

FIG. 4 shows the case where a sheet 2 to be taken out, that is, a sheet on the top of the stacked sheets, is of the small size 2C, and the left edge of the sheet 2C is detected by the detecting means 4*b*. When the detecting means 4*b* is placed on the edge of the sheet 2C as shown in FIG. 4, an air gap is provided below the lip of the detecting means 4*b* because the detecting means 4*b* is slightly tilted due to the thickness of the sheet 2C. Accordingly, even if the pressure reducing source 8 is operated, the air is allowed to enter the detecting means 4*b* through this air gap. Therefore, the hollow elastic member 9*b* connected to same pressure reducing source 8 cannot contract itself, the limit switch 10*b* coupled to the hollow elastic member 9*b* is not operated, and the solenoid valve 7*b* is not operated (the solenoid valve remains closed). In consequence, even if the pressure reducing source 6 for grabbing sheets is operated, the pressure in the suction disk 1*b* is not reduced, and of course the pressure in the suction disk 1*a* branched from the pressure reducing source connection path of the suction disk 1*b* is not reduced. Accordingly, the suction disks 1*a* and 1*b* cannot grab and retain the sheet 2B under the sheet 2C.

On the other hand, the right edge of the sheet 2C is detected by the detecting means 4*f* which is positioned on the right edge in a similar manner as in the case of the left edge detection described above. As a result, the pressure reducing source connection path of the corresponding suction disk 1*f* is interrupted by the solenoid valve 7*f*, and therefore the suction disk 1*f* cannot grab and retain the sheet 2A under the sheet 2C.

As no detection steps such as those described above are provided in the central portion of the sheet 2C, the detecting means 4*c*, 4*d* and 4*e* positioned there are in close contact with the sheet 2C. Accordingly, the corresponding hollow elastic members 9*c*, 9*d* and 9*e* are contracted, the limit switches 10*c*, 10*d* and 10*e* are activated, and the solenoid valves 7*c*, 7*d* and 7*e* are opened. As a result, only the suction disks 1*c*, 1*d* and 1*e* act on the sheet 2C, that is, the sheet 2C is grabbed by the three suction disks and is taken out of the container.

As is apparent from the above, in the sheet supplying apparatus according to this invention, the suction disks are selectively operated depending on the sheet sizes, and a sheet is taken out of the container by sucking the surface of the sheet uniformly along the lateral direction thereof. Therefore, if the size of sheets is larger than a half (½) of the width of the largest size sheet, the sheets can be positively supplied one after another.

Figure 5:
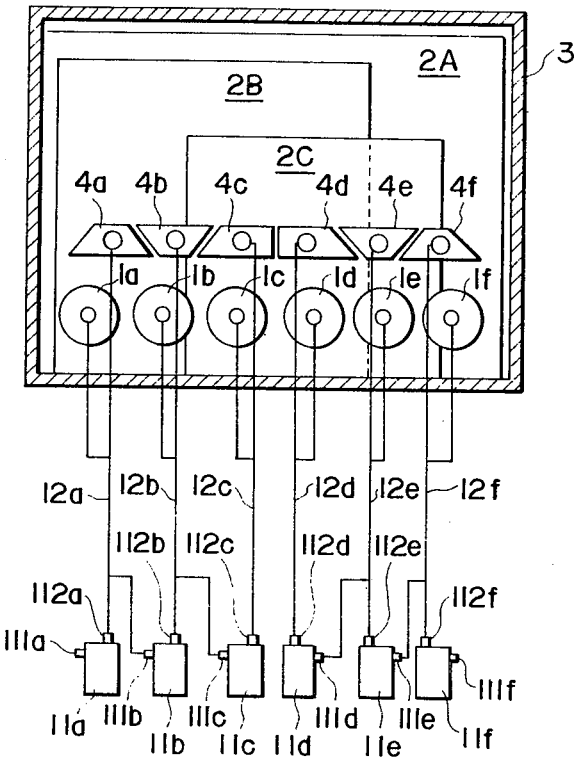
FIGS. 5 and 6 are front views showing other examples of the sheet supplying apparatus according to the invention.

FIG. 5 shows a modification of the suction disk switching system according to the invention. In the above-described example of the sheet supplying apparatus, the suction disk switching operation is effected electrically in response to the detection signals. In the modification shown in FIG. 5, the switching operation is carried out mechanically.

In this sheet supplying apparatus, suction disks 1*a* through 1*f* and corresponding detecting means 4*a* through 4*f* are connected to common pressure reducing pipes 12*a* through 12*f*, respectively. The pressure reducing pipes 12*a* through 12*f* are connected to the sucking inlets 112*a* through 112*f* of pressure reducing sources, namely, suction pumps 11*a* through 11*f*, respectively. The suction pumps are divided into two systems: a first system consisting of the pumps 11*a*, 11*b* and 11*c*, and a second system consisting of the pumps 11*d*, 11*e* and 11*f*. In the first system, the suction inlet 112*a* is connected to the discharge outlet 111*b*, and the suction inlet 112*b*is connected to the discharge outlet 111*c*. In the second system, the discharge outlet 111*d* is connected to the suction inlet 112*e*, and the discharge outlet 114 is connected to the suction inlet 112*f*.

As in the first described case, when air leakage takes place in the detecting means 4*b* (that is, when the detecting disk 4*b* detects the edge of the sheet 2C), the air is discharged through the discharge outlet 111*b* of the suction pump 11*b* and through the suction inlet 112*a* and discharge outlet 111*a* of the adjacent suction pump 11*a*, as a result of which the pressure in the suction disks 1*a* and 1*b* are not reduced (that is, the suction disks 1*a* and 1*b* cannot grab the sheet 2B).

In the above-described examples, the air leakage due to the step formed by consecutive sheets is utilized to detect the edges of a sheet. However, such detection may be achieved electrically by using a strain gauge instead of the detecting means 4. In this case, the strain gauges are employed instead of the detecting means 4 in the above-described examples. More specifically, as in the above examples, a plurality of suction disks 1 are arranged in the lateral direction of a sheet 2, and a plurality of strain gauges are also arranged in correspondence to the suction disks 1, so that the steps at the edges of the sheet 2 are converted into strain variations, and are thus detected as electrical signals. According to this method, a minute displacement of the sheet 2 can be detected. Therefore, the method is effective for detecting the edges of an extremely thin sheet.

Figure 6:
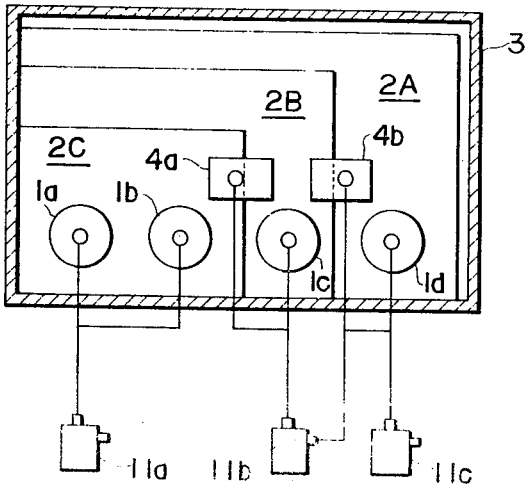

In the above-described examples, sheets 2 are stacked in such a manner that they are aligned at one edge (which is the sheet's forward or lower edge facing the sheet taking-out side) but are not aligned at both lateral edges, so as to be taken out one by one. However, in the case where sheets 2 are stacked in the container with one lateral edge aligned (although the sheet aligning step would be additionally necessary before the operation of the apparatus according to the present invention is started), the aforementioned sheet sucking mechanism can be simplified as shown in FIG. 6. In the case where sheets 2A, 2B and 2C are stacked on the container 3 after they are aligned at one lateral edge as shown in FIG. 6, suction disks (which will be designated by reference characters 1*a* and 1*b*, respectively, for convenience in this description) for grabbing the small size sheets 2C are connected to a pressure reducing source 11*a*, while suction disks 1*c* and 1*d* for selectively grabbing the other sheets 2B and 2A, respectively, and detectors comprising the above-described detecting disks or strain gauges adapted to detect the edges of these sheets (sheets 2C and 2B in this case) are connected as indicated in FIG. 6 to achieve the object of the apparatus. In this case, all the sheets are aligned at one lateral edge, and therefore only the other lateral edge of the sheets is detected to perform the function of the apparatus. Furthermore, as the one lateral edge of each sheet is predetermined, the numbers of detectors, suction disks and pressure reducing sources are much smaller than those in the above-described examples. Therefore, in the case of FIG. 6, these components can be considerably readily manufactured and set, and it goes without saying that sheets of all sizes can be handled.

As is apparent from the above description, according to the invention, sheets different in size which are stacked on the container are positively taken out one after another without damaging the sheets. This is a significant advantage of the invention which cannot be obtained by the conventional sheet supplying apparatus.

What is claimed is :

1. In a sheet supplying apparatus of the type comprising suction disks for sucking and retaining a sheet, a pressure reducing source for applying a suction pressure to said suction disks, and driving means for driving said suction disks, to thereby supply sheets different in size one after another having no particular ordering of size from the topmost to the bottommost wherein the improvement is characterized in that a plurality of suction disks for retaining a sheet are arranged along a lateral direction of said sheets, and an edge detection means separate and distinct from the suction disks is provided for detecting only an edge of a sheet to be taken out and for disabling each of said suction disks beyond the edge of said sheet to be taken out, wherein said edge detection means comprises a plurality of edge detectors corresponding to each of said suction disks, each edge detector disabling its corresponding suction disk upon detecting the edge of the sheet to be taken out, wherein said suction disks are connected in series so that the disabling of one suction disk will result in the disabling of any further suction disks located beyond one suction disk.

2. In a sheet supplying apparatus of the type comprising suction disks for sucking and retaining a sheet, a pressure reducing source for applying a suction pressure to said suction disks, and driving means for driving said suction disks, to thereby supply sheets different in size one after another, wherein the improvement is characterized in that a plurality of suction disks for retaining a sheet are arranged along a lateral direction of said sheets, and an edge detection means is provided for detecting an edge of a sheet to be taken out and for disabling each of said suction disks beyond the edge of said sheet to be taken out, wherein said edge detection means comprises a plurality of suction devices each of which, when positioned over an edge of the sheet to be taken out, will leak due to the level difference between adjacent sheets, wherein said suction devices are trapezoidal in shape with their oblique edges overlapping along the lateral dimension of said sheets.

3. An apparatus according to claims 1 or 2, wherein all of said sheets have first and second lateral edges, wherein all of said first edges are aligned and wherein said edge detection means detects only said second lateral edges.

4. An apparatus according to claims 1 or 3, wherein all of said sheets have first and second lateral edges and wherein said edge detection means detects both said lateral edges and disables any suction disks located beyond either of said lateral edges.

* * * * *